US007425692B2

(12) United States Patent
Orbeck et al.

(10) Patent No.: US 7,425,692 B2
(45) Date of Patent: Sep. 16, 2008

(54) THERMAL PROCESSING SYSTEM HAVING SLOT EDUCTORS

(75) Inventors: Gary Orbeck, Windham, NH (US); Donald A. Seccombe, Jr., Gloucester, MA (US)

(73) Assignee: BTU International, Inc., North Billerica, MA (US)

( * ) Notice: Subject to any disclaimer, the term of this patent is extended or adjusted under 35 U.S.C. 154(b) by 543 days.

(21) Appl. No.: 11/187,192

(22) Filed: Jul. 22, 2005

(65) Prior Publication Data

US 2006/0051715 A1 Mar. 9, 2006

Related U.S. Application Data

(60) Provisional application No. 60/607,681, filed on Sep. 7, 2004.

(51) Int. Cl.
*H05B 6/80* (2006.01)
*F27B 5/06* (2006.01)
*F27B 5/16* (2006.01)

(52) U.S. Cl. ..... 219/681; 219/686; 219/757; 219/762; 432/176; 432/201; 432/205

(58) Field of Classification Search ..... 219/67–686, 219/702, 710, 756–757, 762; 432/176, 196, 432/199–201, 205; 419/52–55
See application file for complete search history.

(56) References Cited

U.S. PATENT DOCUMENTS

| | | | | |
|---|---|---|---|---|
| 3,170,681 | A * | 2/1965 | Davies | 432/47 |
| 3,583,691 | A | 6/1971 | Twine | 263/40 |
| 4,596,526 | A | 6/1986 | Soliman | 432/23 |
| 4,664,618 | A * | 5/1987 | Gitman | 431/11 |
| 5,795,146 | A | 8/1998 | Orbeck | 432/176 |
| 6,693,263 | B2 * | 2/2004 | Nishimura | 219/615 |
| 6,814,572 | B2 | 11/2004 | Okabe | 432/200 |
| 2004/0173608 | A1 | 9/2004 | Seccombe et al. | |

* cited by examiner

*Primary Examiner*—Philip H Leung
(74) *Attorney, Agent, or Firm*—Weingarten, Schurgin, Gagnebin & Lebovici LLP

(57) ABSTRACT

In a system for thermally processing materials, at least one slot eductor is disposed in a wall or roof surface of the furnace chamber to provide circulation of gas within the furnace chamber.

23 Claims, 4 Drawing Sheets

THERMAL PROCESSING SYSTEM HAVING SLOT EDUCTORS

CROSS REFERENCE TO RELATED APPLICATIONS

This application claims the benefit under 35 U.S.C. 119(e) of U.S. Provisional Patent Application No. 60/607,681, filed Sep. 7, 2004, the disclosure of which is incorporated by reference herein.

STATEMENT REGARDING FEDERALLY SPONSORED RESEARCH OR DEVELOPMENT

N/A

BACKGROUND OF THE INVENTION

In the processing of materials such as ceramics, thermal uniformity is often required to achieve uniform heating of the product and to minimize opportunities for distortion, bending or cracking of the product by reason of uneven heating. A system is shown in U.S. Patent Publication No. U.S. 2004-0173608 A1 (U.S. patent application Ser. No. 10/775,542), assigned to the same assignee as the present application, wherein uniform heating is provided by one or more eductors in the furnace chamber which produce high volume gas circulation in the furnace to achieve a highly uniform gas environment and temperature. The one or more eductors can also be employed for forced convection cooling of a product. The one or more eductors are preferably as shown in U.S. Pat. No. 5,795,146, which is also assigned to the assignee of the present invention. The eductors provide high volume flow necessary for improved temperature uniformity and control and can provide a thermal uniformity of about ±3.5° C. during the process cycle.

SUMMARY OF THE INVENTION

The present invention provides a thermal processing system that employs slot eductors in one or more wall or roof surfaces of the furnace chamber. For purposes of the present application the term "slot eductor" means an eductor formed by a slot of any cross sectional shape in a wall or other surface of a furnace chamber and having a nozzle at one end of the slot for directing high velocity gas along the slot. For example, the slot cross section can be of v-shape, rectangular shape or curved shape. Alternatively, the eductor slot can be provided by the corner of joined walls of the furnace chamber, or can be provided by directing a high velocity stream along a portion of the wall itself without any physical slot. As the eductors are provided in or on the furnace walls themselves, there are no constraints on furnace construction due to placement of tube type eductors. Eductors can be provided in the furnace chamber where tube eductors would not fit or would not be operationally practical. Thus, the invention eliminates the need for added tubes or other equipment in the furnace to provide the eductor structures.

The invention is particularly useful in batch type furnaces, especially those having a relatively tall furnace chamber wherein the temperature profile from the top to the bottom of the chamber can tend to be uneven. The invention can also be employed in continuous type furnaces wherein a product is conveyed between furnace sections or chambers of a furnace to perform an intended process cycle.

DESCRIPTION OF THE DRAWINGS

The invention will be more fully described in the following detailed description taken in conjunction with the drawings in which.

DETAILED DESCRIPTION OF THE INVENTION

Figure 2:
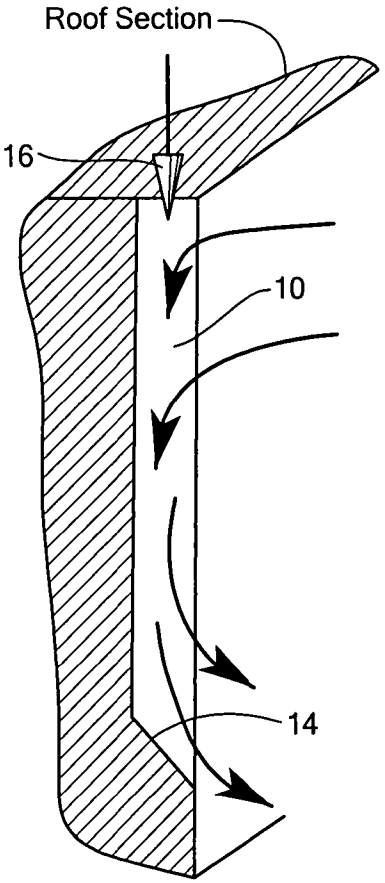
FIG. 2 is a cutaway side elevation view of the slot eductor of FIG. 1.
Figure 1:
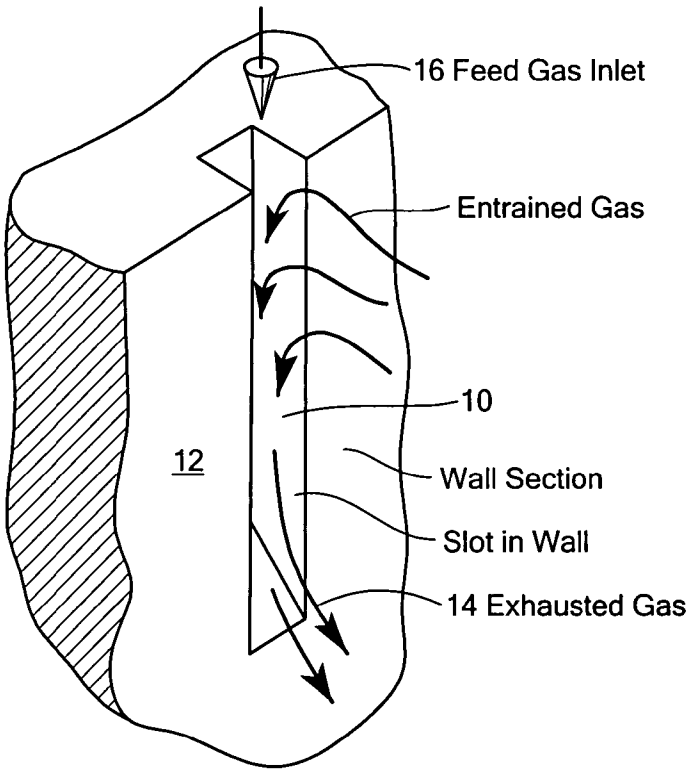
FIG. 1 is a cutaway isometric view of one embodiment of a slot eductor according to the invention.

Referring to the drawings, there is shown in FIGS. 1 and 2 an isometric view and side elevation view, respectively, of an embodiment of a slot eductor. A slot 10 of rectangular cross section is formed in a wall 12 of a furnace chamber. The slot has a downwardly sloping bottom end 14 that provides a bevel or ramp to the wall surface 12 at the lower portion of the slot. The upper end of the slot is at the roof section of the furnace chamber at which a gas inlet or nozzle 16 is positioned for introduction of high velocity gas downward along the length of the slot. The high velocity gas stream causes entrainment of gas from the furnace chamber to provide an amplified volume of gas which is exhausted near the bottom of the slot and which flows from the slot into the chamber. The length and cross sectional dimensions of the slot can be provided to achieve an intended degree of gas amplification and circulation within a furnace chamber of a particular implementation.

Figure 3:
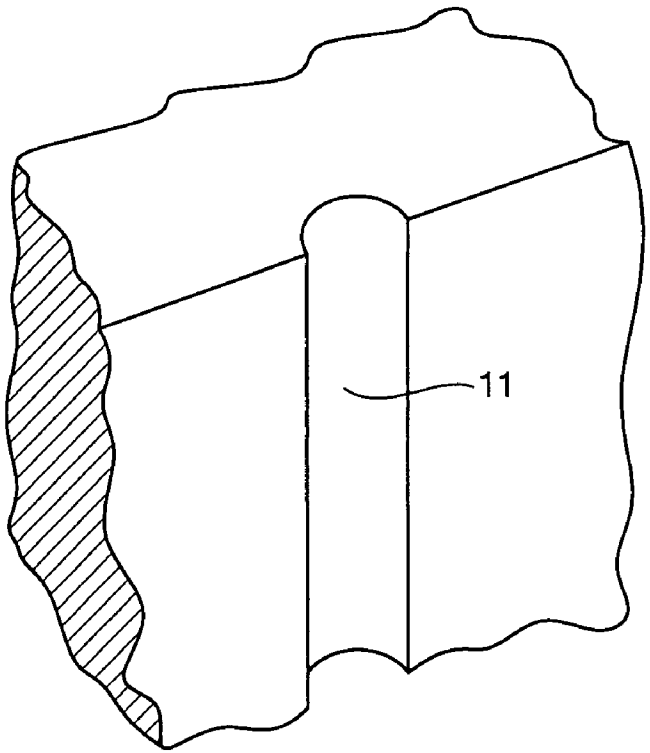
FIG. 3 is a cutaway isometric view of another embodiment of a slot eductor according to the invention.

The slot may be of any cross-sectional shape and is not limited to the rectangular configuration illustrated in the embodiment of FIGS. 1 and 2. The rectangular shape permits relatively easy fabrication by sawing or cutting into the walls of the furnace chamber, which are usually of refractory brick material. The slot can be, for example, of V shape. An alternative embodiment of the slot eductor is shown in FIG. 3 wherein the slot 11 is of semicircular cross-section. Alternatively the slot could have an arc of other than 180° and can be of noncircular shape.

The nozzle or feed gas inlet can be arranged to provide an incoming gas stream of any desired configuration. For example, a conical jet can be provided. In another embodiment, the jet could be rectangular to create a sheet of gas. The cross-sectional shape of the associated slot eductor and the shape of the gas jet can be selected for compatibility. Any gas suitable for the particular application, such as air, nitrogen, argon, or hydrogen, can be used.

The slot eductors make use of the Coanda effect in which a high velocity gas stream tends to follow an adjacent surface along which it is flowing. The high velocity stream creates a low pressure area along the stream that acts to entrain gas from the chamber into the stream, thereby amplifying the volume of gas being moved. The eductor utilizes the energy of the incoming high velocity gas to move much larger amounts of resident furnace chamber gas in the desired direction for the benefit of heat transfer, causing turbulent gas contact with the product in the chamber to enhance out-gassing and to deliver required chemistry to the product. The high volume gas flow in the chamber provided by the eductors also provides uniform heat distribution within the chamber for uniform heating of the product. The slot eductor is capable of moving at least 10 times, and preferably at least 20 times, more volume of gas within the chamber than is introduced into the chamber via the eductor nozzle.

Preferably the length of the slot is at least 10 times greater than the greatest width dimension of the slot in cross-section. A slot that is shorter than this length generally will not aspirate in a sufficient volume of gas to be effective.

Figure 4:
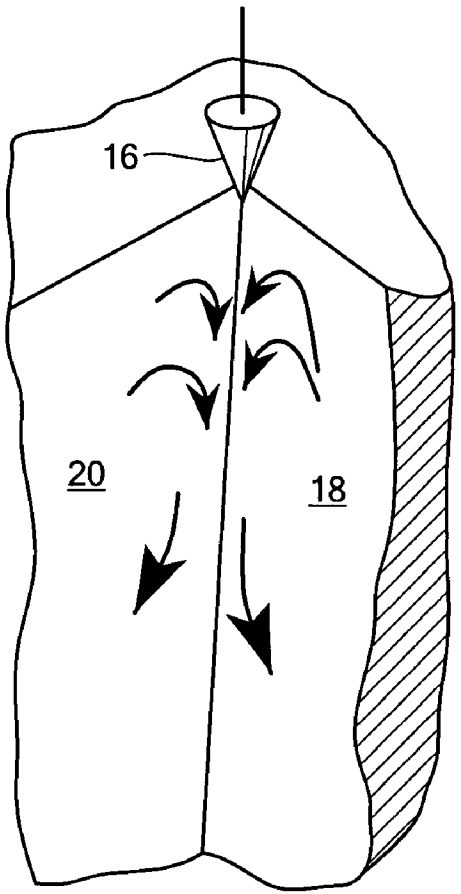
FIG. 4 is an isometric view of a slot eductor formed at a corner of two wall surfaces.

FIG. 4 shows an alternative version of an eductor that is formed by the joined corner walls 18 and 20 of the furnace chamber. A gas nozzle 16 is positioned at the top of the corner and introduces a high velocity stream of gas along the corner edge and confronting wall portions.

Figure 5:
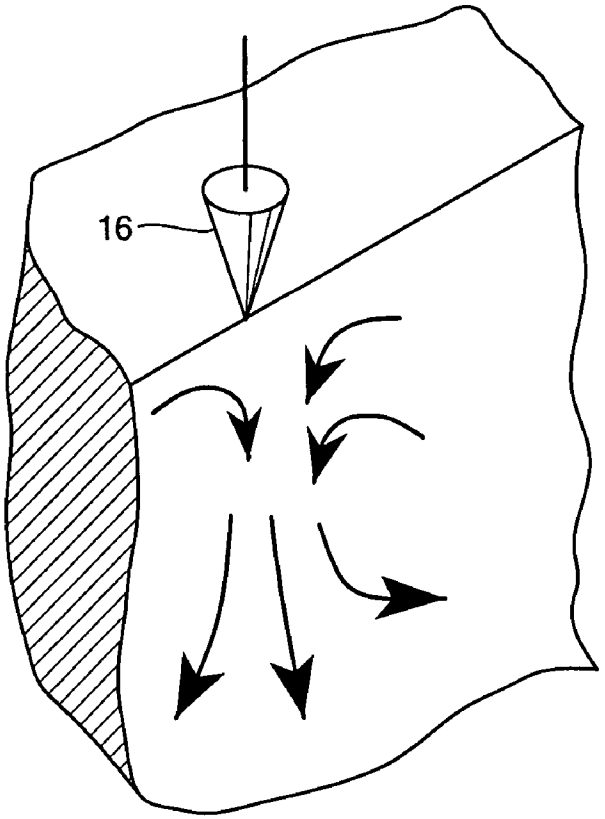
FIG. 5 is an isometric view of an eductor formed along a portion of a wall surface.

A further embodiment is illustrated in FIG. 5 wherein a nozzle 16 is positioned at the top of a wall of the furnace chamber and causes a high velocity gas stream to flow from the nozzle along the wall in a generally linear path. In all of the foregoing embodiments, the high velocity jet causes gas from the chamber to be entrained into the high velocity stream for amplification of the gas and distribution of the amplified gas within the chamber.

The atmosphere in the furnace chamber is typically air, an inert gas such as nitrogen or argon, or a combination thereof for processing low temperature cofired ceramics (LTCC) and other ceramic products and for processing fuel cells. For processing powder metals, the atmosphere is typically a combination of hydrogen and nitrogen. For some purposes, the atmosphere may be water vapor with or without other gas. As noted above, the one or more slot eductors introduce gas into the furnace chamber and provide amplification and circulation of the gas to achieve an intended uniformity of furnace atmosphere and temperature to which the products or materials being processed are exposed. Temperature uniformity of about ±3.5° C. can be achieved by use of the invention. The one or more eductors can also provide forced convection cooling of the product.

The number of slot eductors and their positioning within a furnace chamber is determined to provide an intended gas flow pattern in the particular chamber to produce a uniform temperature and gas environment in the chamber for uniform heating of the product contained therein and for uniform exposure of the product to the gas environment. The eductors may be operated in concert or may be operated in a switched manner to provide an intended gas flow or circulation pattern. For example, the eductors on one side of a furnace chamber may be on while the eductors on the opposite side of the chamber are off, and vice versa during repeated cycles of operation.

Figure 6:
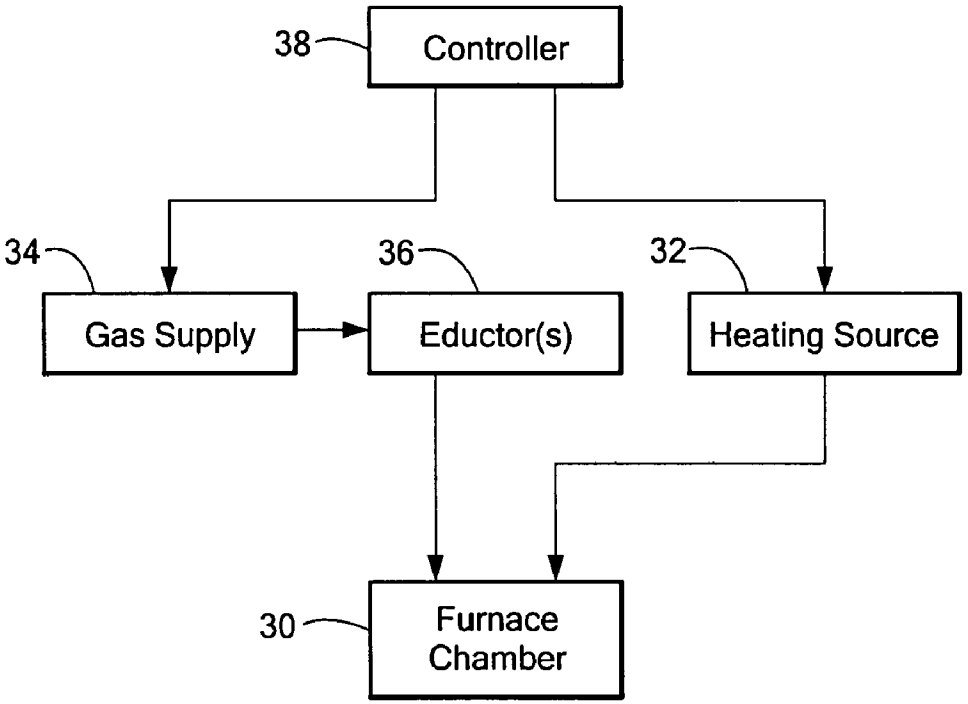
FIG. 6 is a block diagram of a furnace system according to the invention.

The invention can be embodied in a variety of batch type or continuous type furnace systems to suit particular products or materials to be processed and to suit other manufacturing requirements. A furnace system is shown in diagrammatic form in FIG. 6. A furnace chamber 30 is constructed to hold a quantity of materials or products to be thermally processed. Associated with the furnace chamber is a heating source 32 that may be of one or more types. A gas supply 34 provides gas via the one or more eductors 36 to the furnace chamber to provide an atmosphere in the chamber suitable for processing of the particular materials or products. A controller 38 governs the operation of the gas supply and the heating source and is typically a microcontroller or computer.

The heating source can employ convection heaters, radiation heaters, or microwave heaters or combinations thereof. Microwave heating can suitably be employed for debinding and sintering applications. If microwave heating and non-microwave heating are employed, the non-microwave source must be compatible to avoid unwanted microwave reflections or absorption in the furnace chamber. Typically microwave heating can be employed with convection heating in the same chamber. If radiation heating is to be employed, the radiant heaters must usually be in a furnace chamber separate from the chamber heated by microwave energy since the usual radiant heaters are made of silicon carbide or other material, which is microwave absorptive.

The heating source 32 is controlled by controller 38 during the heating cycle to provide an intended thermal profile and to provide uniform volumetric heating of the materials or products throughout the heating cycle. The heating source is controlled during the process cycle in accordance with the particular material or product being processed including the composition of the material and its shape or mass.

Figure 7:
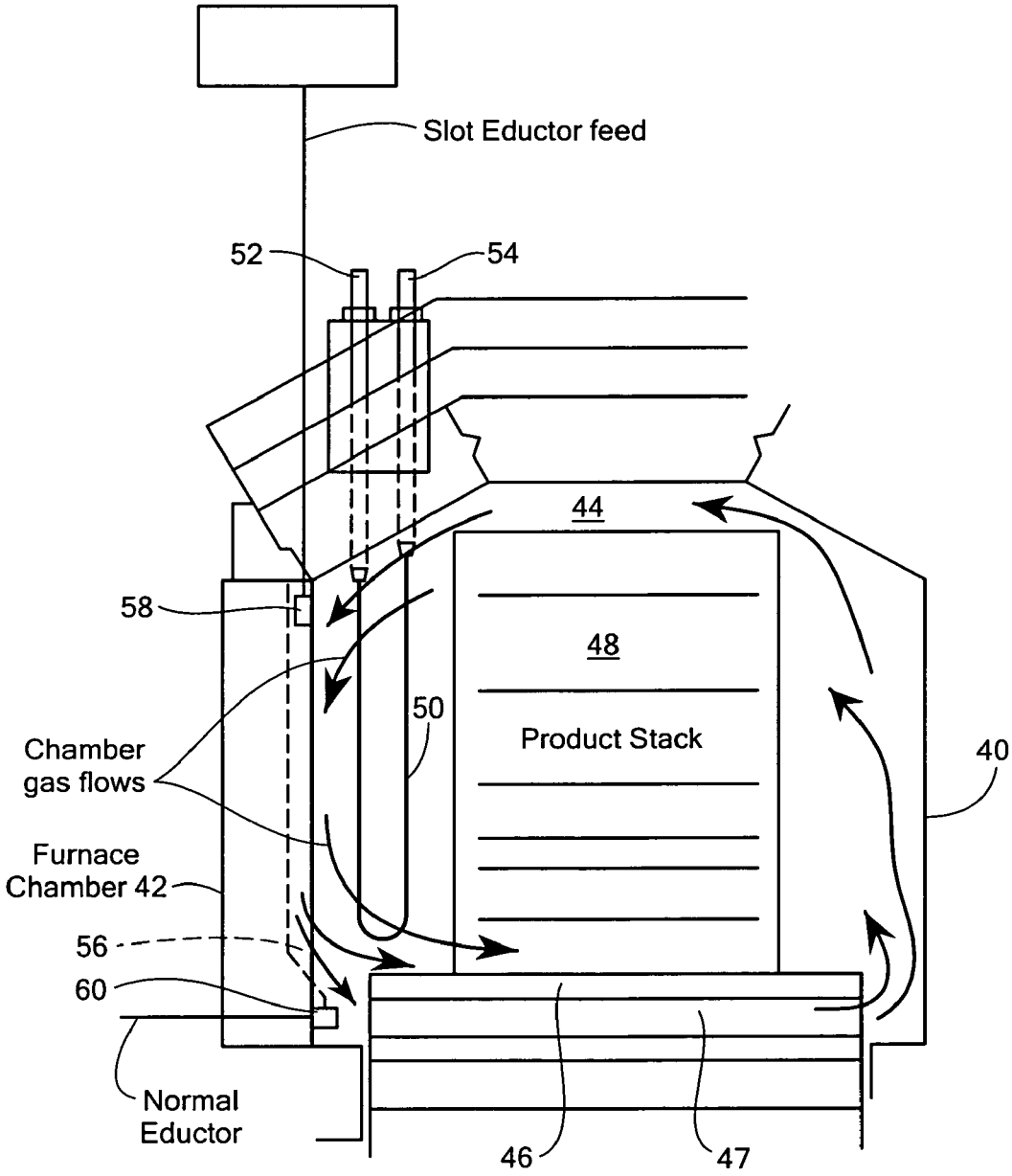
FIG. 7 is a sectional elevation view of a batch furnace chamber in accordance with the invention.

A batch furnace chamber is shown in cross section in FIG. 7 for containing a quantity of materials to be processed. The furnace comprises a housing 40 enclosing insulative material 42 that surrounds the furnace chamber 44. A furnace hearth 46 supports a quantity of materials 48, to be processed. The hearth can be mounted on a movable assembly (not shown) which can be moved upward into the chamber and lowered downward to a position in which the hearth and the product contained on the hearth is outside of the furnace chamber for loading and unloading of the product. An elevator mechanism (not shown) is employed to move the hearth between upper and lower positions. The elevator mechanism may include one or more lead screws or other mechanisms known in the art. Electrical heaters 50 are disposed on each side of the chamber and are each suspended from a mounting 52 retained in the roof section of the chamber. (Only one side is illustrated in FIG. 7.) Terminals 54 are connectable to a suitable electrical power source. The number and configuration of the heaters can vary to suit the intended heating requirements.

Slot eductors 56 are disposed in each sidewall of the furnace. (Only one side is illustrated in FIG. 7.) A plurality of eductors are disposed along each side of the furnace, each eductor on one side being generally in line with an eductor on the opposite side. Each of the eductors is fed with gas from a gas source and which is provided to a gas jet or nozzle 58 disposed in an opening in the roof section of the chamber at the top end of the eductor slot which is at or near the roof section of the furnace chamber.

One or more openings 47 extend through the hearth 46 from one side of the chamber to the other side. An eductor 60 is disposed in the side wall adjacent each end of the opening 47. The eductor 60 is preferably a tube type eductor as shown in U.S. Pat. No. 5,795,146, assigned to the assignee of the present invention and the disclosure of which is incorporated herein by reference. The one or more openings 47 provided through the hearth provide a circulation path through the hearth from one side of the furnace chamber to the other side of the chamber. The eductors 60 operate in concert with the slot eductors 56 to provide recirculation of the gas within the chamber to achieve intended uniformity of temperature and gas exposure to the product.

As noted above, the high velocity gas flow from the eductors causes entrainment of gas in the furnace chamber into the gas stream and amplification and circulation of the gas. Ratios of the volume of entrained gas with respect to the volume of injected gas of up to 50:1 can be achieved. Preferably, a ratio of at least 10:1 and more preferably at least 20:1 is achieved for good furnace operation.

In one embodiment, the eductors can be operated in complementary manner such that for one time interval the eductors on one side of the furnace chamber are on, while the eductors on the opposite side of the chamber are off. For the next time interval, the operation of the eductors is reversed such that the formally off eductors are on, while the formerly on eductors are off. The alternating operation of the eductors provides further uniformity of the atmosphere within the chamber by reason of the alternating circulatory flow paths. In the off mode, the nozzles to the slot eductors are not completely shut off, but provide a small amount of gas flow, typically about 5% of full flow, to cool the gas nozzle to avoid damage to the gas nozzle at the high operating temperatures of the furnace and to avoid air or other contaminants entering the furnace chamber through the nozzle assembly.

The eductors can also be employed to provide forced convection cooling of the product such as during the cool down portion of a thermal cycle. The gas flow from the eductors is controlled in conjunction with control of the heat sources to achieve an intended rate of cooling of the product.

The number and arrangement of eductors in the furnace chamber is determined to provide an intended gas flow pattern within the chamber to achieve the requisite temperature uniformity and uniform gas environment. The arrangement illustrated in FIG. 7 is exemplary for one type of batch furnace. The invention can be employed in other types of batch furnaces such as those having a fixed hearth. For some embodiments it is not necessary to have eductors 60 as shown in FIG. 7, as the gas flow can be provided solely by the slot eductors in the furnace walls.

The materials or products to be processed are retained in a suitable support assembly. One typical form of support is a tray having multiple compartments for respective items to be processed, the trays being stackable, one on top of the other, such that a relatively large quantity of items can be processed at a single time within the furnace chamber. The support assembly can be of other types such as a suitably configured rack for holding particular products or items to be processed. For some purposes it is useful to sandwich the product between upper and lower plates or other supports to prevent distortion of the product during the heating cycle. The product holders are made of a refractory material capable of withstanding the operating temperatures of the furnace.

The invention can also be embodied in a continuous thermal process and system. In such a system a product is conveyed along a furnace chamber which typically can have multiple zones to provide an intended heating and cool down cycle which is suitable for the particular product or material being processed. The slot eductors can be configured within the furnace chamber in similar manner as described above to provide uniform heating and amplified gas volume. One or more eductors can also be arranged along the length of the furnace chamber to propel gas resident within the chamber along the furnace length such as to ensure that dirty furnace atmosphere is being pushed to the exhaust area near the front end of a furnace.

The invention is not to be limited by what has been particularly shown and described. The invention can be embodied in batch and continuous type furnaces of various constructions and in single and multi zone furnaces. The invention can also be utilized with a variety of conveyer mechanisms to move products into and out of the furnace or to convey products between furnace sections or zones. It is therefore intended that the invention should comprehend the full spirit and scope of the appended claims.

What is claimed is:

1. A system for thermally processing materials comprising:

a furnace housing comprising a bottom, a roof and one or more walls, and a furnace chamber within the furnace housing;

a support assembly disposable in the furnace chamber for supporting the materials to be thermally processed;

a heating source operative to heat the materials in the furnace chamber; and at least one slot eductor disposed in a wall or roof surface of the furnace chamber to provide circulation of gas within the furnace chamber, the slot eductor in communication with a gas supply, the slot eductor comprising:

a slot disposed in the wall or roof surface of the furnace chamber, the slot elongated from an inlet end to an outlet end in a direction parallel to the wall or roof surface, and a gas inlet disposed at the inlet end of the slot in communication with the gas supply and arranged to direct inlet gas along the slot parallel to the wall or roof surface to provide a high velocity gas flow along the slot, the inlet end of the slot open to the furnace chamber to entrain gas in the furnace chamber into the gas flow along the slot, and the outlet end of the slot open to the furnace chamber to exhaust gas into the furnace chamber, to provide high volume circulation of gas within the furnace chamber.

2. The system of claim 1, wherein the slot is disposed in the wall of the furnace chamber and extends from the roof of the furnace chamber downwardly, and the gas inlet is disposed at the top of the slot to provide high velocity gas along the slot to entrain gas in the furnace chamber to provide high volume circulation of gas within the furnace chamber.

3. The system of claim 1, wherein the gas inlet provides a conical jet of gas.

4. The system of claim 1, wherein the gas inlet provides a sheet of gas.

5. The system of claim 1, wherein the slot has a length at least 10 times greater than a largest cross-sectional dimension of the slot.

6. The system of claim 1, wherein the slot has a cross-sectional configuration that is square, rectangular, circular, curved, straight-sided, or V-shaped.

7. The system of claim 1, wherein the slot comprises a corner between two walls of the furnace chamber.

8. The system of claim 1, further comprising a plurality of slot eductors.

9. The system of claim 1, further comprising a plurality of slot eductors on first and second sides of the furnace chamber for providing a uniform gas atmosphere in the furnace chamber.

10. The system of claim 9, further comprising a hearth, a plurality of openings extending through the hearth from one side of the furnace chamber to the other side of the furnace chamber; and wherein the plurality of slot eductors on first and second sides of the furnace chamber are arranged in pairs, each pair of slot eductors aligned on respective sides of the furnace chamber with a respective opening through the hearth.

11. The system of claim 10, further comprising a plurality of tubular eductors each disposed in a respective sidewall opening of the furnace housing and confronting a respective opening through the hearth.

12. The system of claim 11, wherein the tubular eductors each includes a tubular body having a nozzle in communication with a gas supply and providing high velocity gas into the furnace chamber and disposed to entrain gas in the furnace chamber to provide high volume circulation of gas within the furnace chamber.

13. The system of claim 1, further comprising a controller operative to control the gas supply to the eductor.

14. The system of claim 1, further comprising a controller operative to control the heating source to provide an intended thermal profile during a heating cycle.

15. The system of claim 14, wherein the controller is operative to control the gas flow of the slot eductors.

16. The system of claim 1, wherein the slot eductors are operative to provide forced convection cooling of the materials during a portion of a thermal cycle.

17. The system of claim 1, including at least one slot eductor on each side of the furnace chamber and operative in alternating manner to provide uniform circulation of gas in the chamber and uniform heating of the materials.

18. The system of claim 1, wherein the heating source includes one or more electrically energized heaters disposed in the furnace chamber.

19. The system of claim 1, wherein the heating source includes one or more microwave heaters disposed in the furnace chamber.

20. The system of claim 1, wherein the furnace chamber is in a batch furnace operative to have materials loaded therein for processing and unloaded after processing.

21. The system of claim 1, wherein the furnace chamber is in a continuous furnace operative to have materials conveyed therethrough during a processing cycle.

22. The system of claim 1, wherein the support assembly includes an elevator hearth moveable between a lower position for loading and unloading of materials to be thermally processed, and an upper position for disposing the materials in the furnace chamber.

23. The system of claim 1, wherein the slot eductor comprises a portion of the wall of the furnace chamber extending from the roof of the furnace chamber downwardly, and a gas nozzle disposed at the top of the portion of the wall in the roof to provide high velocity gas along the portion of the wall to entrain gas in the furnace chamber to provide high volume circulation of gas within the furnace chamber.

* * * * *